US009370216B2

(12) United States Patent
Brantley

(10) Patent No.: US 9,370,216 B2
(45) Date of Patent: Jun. 21, 2016

(54) SAFETY HELMET

(76) Inventor: Charles W. Brantley, Orlando, FL (US)

( * ) Notice: Subject to any disclaimer, the term of this patent is extended or adjusted under 35 U.S.C. 154(b) by 816 days.

(21) Appl. No.: 13/527,814

(22) Filed: Jun. 20, 2012

(65) Prior Publication Data

US 2013/0340150 A1 Dec. 26, 2013

(51) Int. Cl.
*A42B 3/12* (2006.01)
*A42B 3/20* (2006.01)

(52) U.S. Cl.
CPC .. *A42B 3/121* (2013.01); *A42B 3/20* (2013.01)

(58) Field of Classification Search
USPC ..... 2/425, 411, 412, 414, 424, 410, 9
See application file for complete search history.

(56) References Cited

U.S. PATENT DOCUMENTS 3,946,441 A * 3/1976 Johnson ..... 2/412
4,500,075 A * 2/1985 Tsuchiya et al. ..... 267/226
4,513,449 A * 4/1985 Donzis ..... 2/462
4,700,403 A * 10/1987 Vacanti ..... 2/462
5,274,846 A * 1/1994 Kolsky ..... 2/460
5,423,087 A * 6/1995 Krent et al. ..... 2/463
5,913,412 A * 6/1999 Huber et al. ..... 2/414
5,956,777 A * 9/1999 Popovich ..... 2/424
6,070,271 A * 6/2000 Williams ..... 2/412
6,425,141 B1 * 7/2002 Ewing et al. ..... 2/412
7,341,776 B1 * 3/2008 Milliren et al. ..... 428/319.3
7,607,179 B2 * 10/2009 Shih ..... 2/411
7,761,933 B2 * 7/2010 Pham ..... 2/410
8,039,078 B2 10/2011 Moore, III et al.
41,183 A1 * 1/2012 Moore et al. ..... 2/414
2001/0032351 A1 * 10/2001 Nakayama et al. ..... 2/412
2002/0184699 A1 * 12/2002 Ewing et al. ..... 2/412
2005/0166302 A1 * 8/2005 Dennis ..... 2/414
2006/0031978 A1 * 2/2006 Pierce ..... 2/414
2006/0059605 A1 * 3/2006 Ferrara ..... 2/410
2007/0056081 A1 * 3/2007 Aspray ..... 2/411
2007/0151003 A1 * 7/2007 Shih ..... 2/424
2007/0245464 A1 * 10/2007 Baker ..... 2/411
2008/0066217 A1 * 3/2008 Depreitere et al. ..... 2/412
2010/0299813 A1 * 12/2010 Morgan ..... 2/414
2011/0209272 A1 * 9/2011 Drake ..... 2/411
2012/0204327 A1 * 8/2012 Faden et al. ..... 2/411

* cited by examiner

*Primary Examiner* — Andrew W Collins

(57) ABSTRACT

The present invention is for a safety helmet having a hard outer shell having a plurality of protective flexible air bags for protecting a person's head against blows to the helmet outer shell and having a shock absorbing face guard. Each air bag may have a plurality of cushioning air bags enclosure layers mounted to a thin foamed polymer shell lining. Each enclosure layer of each air bag has an interior filled with a resilient multi-cellular sponge like material, such as a shaped foamed polyurethane sponge, and has a plurality of air escapement openings sized to meter the release of air under impact to the helmet hard shell under predetermined pressure with a different air release pressure for each enclosure layer.

10 Claims, 2 Drawing Sheets

SAFETY HELMET

BACKGROUND OF THE INVENTION

This invention relates to safety helmets and especially to a helmet having air bag cushioning with a shock absorbing face guard for greater head protection for athletes, cyclists, and the like.

It has been shown that persons involved in high speed activities such as motor cross racing, riding motorcycles and bicycles, automobiles and the like can substantially reduce the severity of head injuries in an accident by the use of protective helmets. In the past, many athletes and those in hazardous activities wear some type of head protection. The helmet provides protection to the head of the wearer by dissipating the energy of an impact to the head of the wearer. To obtain better protection, the energy of an impact to the helmet must be dissipated by dispersing the energy in the helmet over as wide an area as possible while preventing a concentrated impact to the head. It is therefore desirable to redistribute the energy from a single concentrated point of impact on the outside of the helmet to a broader area throughout the entire outer and inner area of the helmet and helmet liner while at the same time cushioning the head and preventing concentrated impact thereto.

Currently, most helmets have an outside very hard plastic shell and are lined with a protective liner, such as a one and a half inch lining of rigid polyurethane foam. This allows a great deal of the impact to the helmet to be applied to a small portion of the wearer's head with only limited distribution of total energy of impact. In addition a hard blow against a helmet's face mask or face guard produces a jarring of the wearer's head which can also drive the wearer's helmet and head and damage a person's face or neck.

The present invention is directed toward a new helmet and face guard combination which supports the wearer's head with an air bag like protection while distributing the energy of an impact over a wider area of the helmet and which also cushions a blow to the face guard to reduce the force applied to the head and neck. A multiple air bag protection design provides an air bag with one or more flexible enclosures. In air bags with multiple enclosure layers, the first layer cushions against smaller forces of impact while a second enclosure layer cushions against a greater impact force than the first enclosure layer and a third layer can provide added protection over the first and second enclosure layers against even greater forces of impact. The transfer of energy is allowed to both dissipate and be redirected away from the wearer's head and brain.

SUMMARY OF THE INVENTION

A safety helmet has a rigid outer shell formed of a polymer material and a foam polymer lining, such as foamed polyurethane, fixedly lining the inside surface of the shell. A plurality of cushioning air bags or pads are attached to the inside of the outer shell over the foamed polymer lining, with each cushioning air bag having at least one flexible enclosure but may have a plurality of individual layers of air impervious enclosures, each being filled with a resilient foam polymer, such as a resilient polyurethane foam. Each air bag enclosure has a predetermined number of apertures of a predetermined size to allow air escapement upon a predetermined impact force. Each air bag may have a plurality of enclosure layers, each having a different size and number of apertures to require a different impact pressure thereon to expel air therefrom. A shock absorbing face guard is attached to the outer shell and positioned to extend in front of the face of a user for absorbing impact thereto. Each of a plurality of cushioned air bag enclosure layers has a plurality of apertures of a predetermined size and number to increase the impact required to expel air therefrom between the outer most enclosure layer and the inner most enclosure layer of an air bag. The face guard has a plurality of connections to the rigid shell, at least two of which connections have a shock absorber fixedly attached to the rigid shell and connecting the face guard to the helmet to absorb shock received to the face guard. Each shock absorber has a piston mounted in an air cylinder and has a piston rod extending therefrom. The piston rod is attached to the face guard with a flexible or gimbaled connection. An impact to the face guard moves the piston to drive air from the cylinder out openings on the rear end of the cylinder while pulling air in through openings in the front of the cylinder. A return spring in the cylinder returns the piston after an impact thereto.

BRIEF DESCRIPTION OF THE DRAWINGS

The accompanying drawings, which are included to provide further understanding of the invention and are incorporated in and constitute a part of the invention and together with the description serve to explain the principles of the invention.

In the drawings.

DETAILED DESCRIPTION OF EXEMPLARY EMBODIMENT

Figure 1:
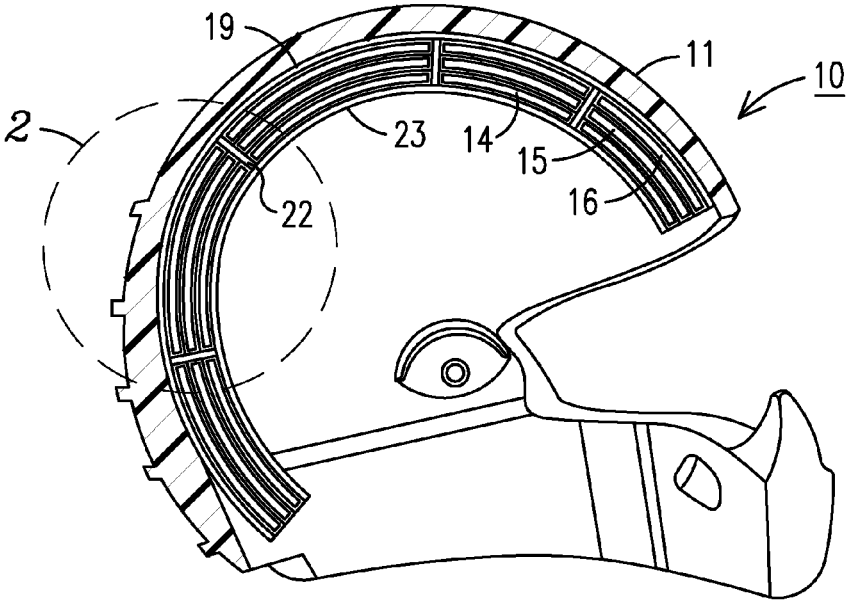
FIG. 1 is a sectional view of a safety helmet in accordance with the present invention showing the air bag layer.

The present invention as shown in the drawings, FIGS. 1 through 5, is for a safety helmet 10 having a hard outer shell 11 having a plurality of protective flexible air bags 12 mounted on the inside of the hard outer shell 11 for protecting a wearer's head. The helmet includes a shock absorbing face guard 13. Each flexible air bag 12 may be multi-layered as shown in the drawings, FIGS. 1 through 3, each air bag has three layers of cushioning air bags 14, 15, and 16 over a hard outer shell 11 inside an inner lining 19. Each air bag enclosure layer has an interior filled with a resilient multi-cellular sponge like material 17, such as a shaped polyurethane foam block, and has a plurality of air escapement openings 18, 20 and 21 sized to meter the release of air under impact to the helmet outer shell. A predetermined pressure is required for each layer which is different for each air bag layer. It should however be clear that while a three layered air bag has been described, any number of air bags layers is including within the spirit and scope of the invention.

Figure 2:
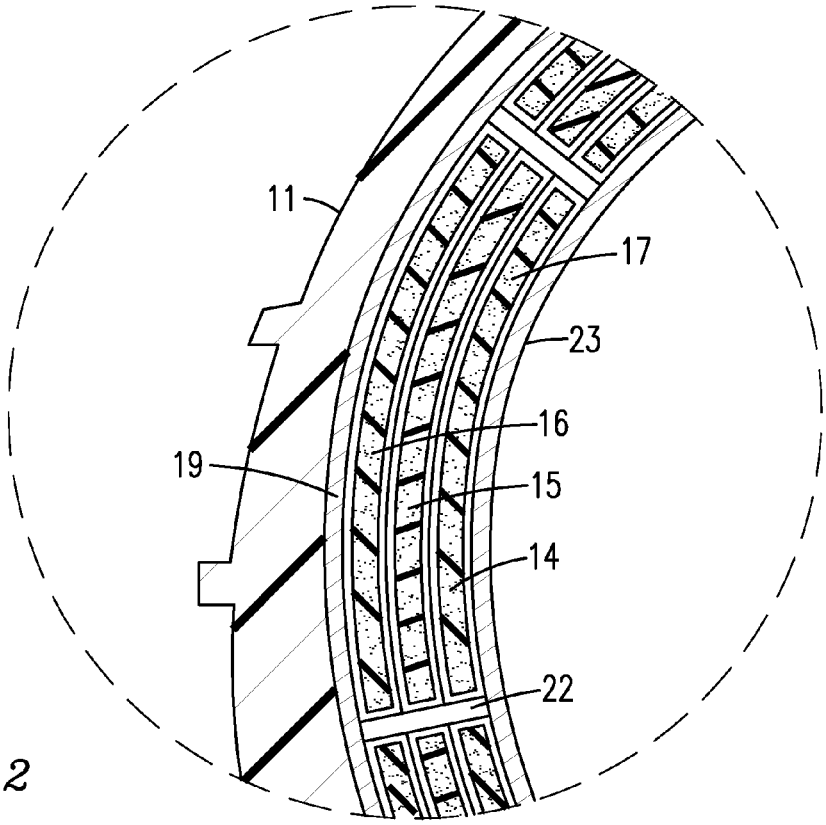
FIG. 2 is a partial sectional view of a portion of FIG. 1 showing details of the air bag layers of the helmet.
Figure 3:
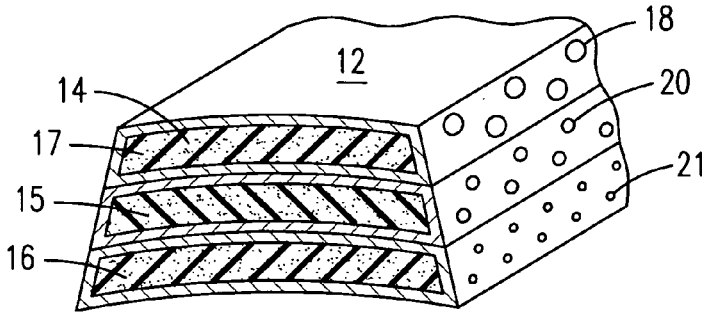
FIG. 3 is a cut-a-way perspective view of one multi-layer air cushioning pad of the present invention.

Referring to the drawings, FIGS. 1 through 3, each multi-layer flexible air bag 12 is spaced from each other air bag 12 with a space 22 and is attached to the hard outer shell 11 inner layer 19. A fabric layer 23 lines the inside of the helmet covering the plurality of air bags 12.

In operation, an impact upon the helmet 10 hard outer shell 11, which jars the head of the wearer, whose head is first cushioned by one or more air bags 12 first enclosed layer 14 having the larger air escapement openings 18 with the resilient sponge material 17 therein which collapses under a predetermined pressure. Once the first air bag layer 14 collapses, the wearer's head is further cushioned by the second air bag layer enclosure 15 having smaller openings 20 which collapses thereinto against the resilient material 17 therein and which requires a greater force to collapse than was required by the first air bag layer enclosure 14 due to the smaller air escapement openings 20. A greater impact against the outer shell 11 is further cushioned by the third layer enclosure 16 of the air bag 12 which has even smaller escapement openings 21 and thus requires an even greater force thereagainst to collapse against the resilient material 17 therein. A final layer of protection is provided with the outer shell 11 inner layer 16 of a rigid foamed polymer, such as a polyurethane or polystyrene polymer. Each air bag 12 layer has room to collapse by the spacing 22 between the air bags 12.

Figure 4:
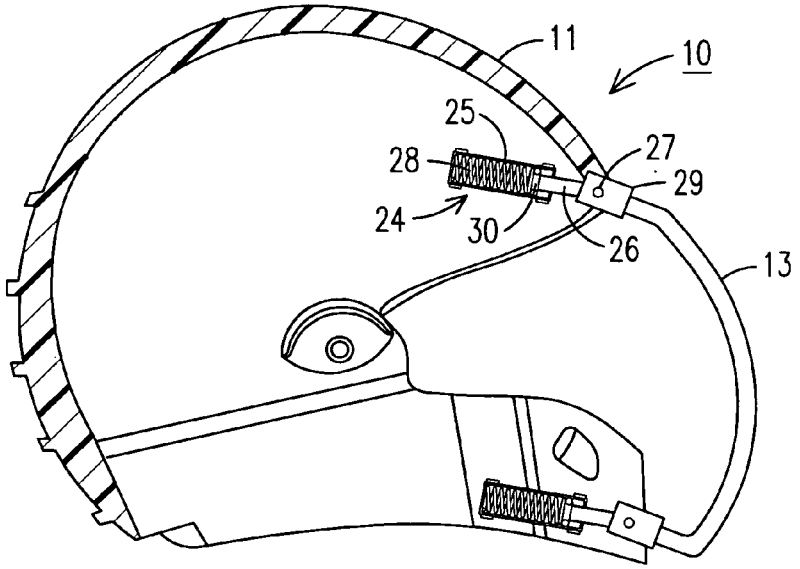
FIG. 4 is a sectional view of the helmet of FIG. 1 having the face guard attached thereto with a plurality of shock absorbers.
Figure 5:
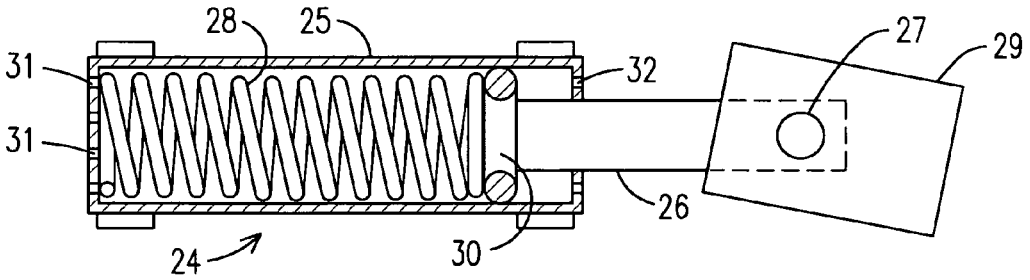
FIG. 5 is a sectional view taken through a shock absorber of FIG. 4.

Referring to FIGS. 4 and 5, the helmet 10 can be seen to have a face guard 13 attached thereto to protect the face of the wearer. The face guard 13 is attached to a plurality of shock absorbers 24 which are in turn rigidly attached to the helmet 10 hard outer shell 11. Each shock absorber 24 has an air cylinder 25 and a cylinder rod 26. Each shock absorber 24 cylinder rod 26 has a hinged connector 27 mounted in a face guard attaching member 29. The hinge attaches the face guard to the cylinder rod 26 of the shock absorber 13 to allow movement between the face guard and the helmet. The air cylinder 25 has a plurality of apertures 31 in the rear thereof to allow air to be pushed thereout when the rod and piston are driven in the cylinder upon impact to the face guard. The apertures are sized to give resistance to the movement of the piston 30. A plurality of apertures 32 in the front end of the cylinder 25 allows air to enter the cylinder when the piston is being driven by an impact to the face guard. A piston return spring 28 is positioned inside the cylinder 25 to return the piston in the cylinder after the impact. When the face guard 13 receives an impact thereagainst the shock absorbers 13 absorbs shock between the face guard and the helmet providing additional protection to the head and neck of the wearer of the helmet. The shock absorber piston is spring loaded with the return spring 28 located inside the cylinder 25 to return the slidable piston 30 after an impact. In FIGS. 4 and 5 two shock absorbers 14 are shown on one side of the helmet which would also have two on the other side to provide four shock absorbers on the helmet but it should be clear that any number of shock absorbers can be used depending on the face guard design.

It should be clear at this time that a safety helmet has been provided which provides all around protection to a wearer from impact against the hard outer shell of the helmet or against the face guard of the helmet. However it should be clear that the present invention is not to be considered as limited to the forms shown which are to be considered illustrative rather than restrictive.

I claim:

1. A safety helmet comprising:

a rigid outer shell formed of a polymer material and having inside and outside surfaces;

a foamed polymer lining fixedly attached to the inside surface of said hard outer shell; and a plurality of cushioning air bags attached in layers to the inside of said hard outer shell over said foamed polymer lining, each layer of said plurality of cushioning air bags having a flexible air impervious enclosure, each said enclosure being filled with a resilient foamed polymer and each said enclosure having a plurality of apertures therein, and each said enclosure plurality of apertures being of a size and number different from at least one other said enclosure to thereby require a different predetermined force on the enclosure to expel air therefrom;

whereby a safety helmet provides shock absorption therein for the safety of the wearer of the helmet.

2. The safety helmet in accordance with claim 1 in which each of said plurality of cushioning air bag enclosure layers is filled with a resilient foamed polyurethane.

3. The safety helmet in accordance with claim 2 in which said rigid outer shell inside surface is covered with a rigid foamed polyurethane.

4. The safety helmet in accordance with claim 1 in which a shock absorbing face guard is attached to said rigid outer shell and positioned to extend in front of the face of a wearer whereby a safety helmet provides shock absorption for the faceguard of the helmet.

5. The safety helmet in accordance with claim 4 in which said face guard has a plurality of connections to said rigid outer shell, at least two of said connections having a shock absorber fixedly attached to said rigid outer shell to absorb shock between said face guard and rigid outer shell.

6. The safety helmet in accordance with claim 5 in which said face guard has four said connections to said rigid outer shell, each connection having a shock absorber fixedly attached to said rigid shell to absorb shock from said face mask.

7. The safety helmet in accordance with claim 6 in which each said shock absorber has a piston mounted in a cylinder and a piston rod extending therefrom and attached to said face guard.

8. The safety helmet in accordance with claim 7 in which said piston rod is attached to said face guard with a hinged connection.

9. The safety helmet in accordance with claim 8 in which said shock absorber cylinder has a plurality of openings in each end thereof for air under pressure to pass therethrough.

10. The safety helmet in accordance with claim 9 in which each said shock absorber cylinder has a piston return spring therein for returning said piston after an impact against said face guard.

* * * * *